United States Patent [19]

Liebhold

[11] Patent Number: 4,583,778

[45] Date of Patent: Apr. 22, 1986

[54] FOLDING KNOCK-DOWN CHAIR, WITH SWINGABLE SEAT SUPPORT

[76] Inventor: Martin R. Liebhold, 12404 Rochedale La., Los Angeles, Calif. 90049

[21] Appl. No.: 698,188

[22] Filed: Feb. 5, 1985

[51] Int. Cl.[4] ..... A47C 4/00

[52] U.S. Cl. ..... 297/56; 297/441; 297/457

[58] Field of Search ..... 297/56, 55, 16, 457, 297/441

[56] References Cited

U.S. PATENT DOCUMENTS

| | | | |
|---|---|---|---|
| 1,969,313 | 8/1934 | Meeker | 297/441 X |
| 2,564,915 | 8/1951 | Nelson | 297/441 X |
| 2,689,602 | 9/1954 | Morgan . | |
| 2,691,410 | 10/1954 | Boucher . | |
| 2,712,349 | 7/1955 | Le Voir . | |
| 2,722,972 | 11/1955 | Altruda | 297/441 X |
| 3,222,108 | 12/1965 | Pablos | 297/457 X |
| 3,708,204 | 1/1978 | Wachmann . | |
| 3,792,882 | 2/1974 | Varichon . | |
| 3,826,194 | 9/1974 | Milette et al. | 297/457 |
| 3,838,883 | 10/1974 | Machen . | |
| 4,047,752 | 9/1977 | Rohr . | |
| 4,081,868 | 4/1978 | Hull . | |
| 4,089,560 | 5/1978 | de Mattos | 297/457 |
| 4,251,106 | 2/1981 | Gilbert . | |
| 4,270,799 | 6/1981 | Flaum . | |
| 4,421,356 | 12/1983 | Singer . | |

FOREIGN PATENT DOCUMENTS

| | | | |
|---|---|---|---|
| St7619 | 8/1956 | Fed. Rep. of Germany . | |
| 793017 | 11/1935 | France . | |
| 1184910 | 2/1959 | France . | |
| 1218839 | 12/1959 | France . | |
| 545995 | 7/1956 | Italy . | |
| 208503 | 2/1940 | Switzerland | 297/56 |
| 9843 | of 1885 | United Kingdom . | |
| 1288461 | 9/1972 | United Kingdom . | |

*Primary Examiner*—Francis K. Zugel

*Attorney, Agent, or Firm*—William W. Haefliger

[57] ABSTRACT

A butterfly chair, capable of rapid assembly, includes (a) a framework that includes two U-shaped members, the first having a lower cross piece and two first legs that project upwardly and forwardly, and the second having a lower cross piece and two second legs that project upwardly and rearwardly, (b) pivots interconnecting the first and second legs at two locations, so that the members may swivel between collapsed and extended positions, (c) the legs restrained against collapse in said extended positions, and (d) the upper terminals of the legs being hook shaped for loose reception in pockets of a flexible sheet providing a seat and backrest.

8 Claims, 9 Drawing Figures

FOLDING KNOCK-DOWN CHAIR, WITH SWINGABLE SEAT SUPPORT

BACKGROUND OF THE INVENTION

This invention relates generally to a butterfly chair construction, and more particularly concerns a butterfly knock-down chair whose elements may be packaged in a relatively small container, for shipping; and such elements may be removed from the container for rapid assembly into a one-piece unit.

Butterfly chairs have been known for many years, but the problem of handling and shipping them in frame-formed condition has remained. As a result, the chairs were difficult to package, transport and store, due to their bulky and ungainly shapes and relatively large size.

SUMMARY OF THE INVENTION

It is a major object of the invention to provide butterfly chair components of such design and construction as will enable extremely easy shipment and handling.

Basically, the improved chair construction comprises (a) a framework that includes two U-shaped members, the first having a lower cross piece and two first legs that project upwardly and forwardly, and the second having a lower cross piece and two second legs that project upwardly and rearwardly, (b) pivots interconnecting the first and second legs at two locations, so that said members may swivel between collapsed and extended positions, (c) means restraining collapse of the legs in said extended position, and (d) the upper terminals of the legs being hook shaped for loose reception in pockets of a flexible sheet providing a seat and backrest.

Further, the upper hook shaped terminals of the second legs are mounted to rotate about axes that are defined by said second legs, so as to conform to the shape of the pockets in which said terminals are received; and the second legs typically have lower and upper sections, the hook shaped terminals integral with said upper sections, there being inserts projecting between the upper and lower sections of each second leg, one section attached to the insert and the other section free to swivel on and relative to the insert.

As will be seen, the upper hook shaped terminals of the first legs are fixed and non-rotatable relative to the front legs; and such terminals may extend inwardly with downward inclination, relative to horizontal, to aid in adjustment of the canvas seat to the figure of the sitter.

These and other objects and advantages of the invention, as well as the details of an illustrative embodiment, will be more fully understood from the following specification and drawings, in which:

DRAWING DESCRIPTION

Figure 2:
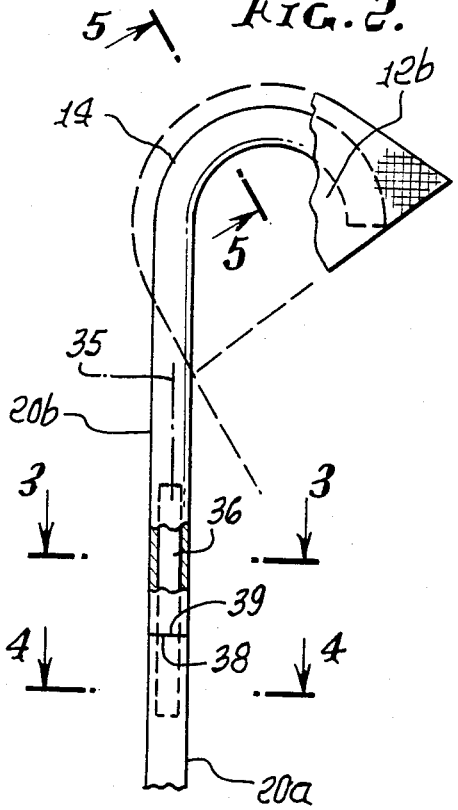
FIG. 2 is an enlarged fragmentary section showing interconnection of leg sections, one of which swivels relative to the other.
Figure 3:
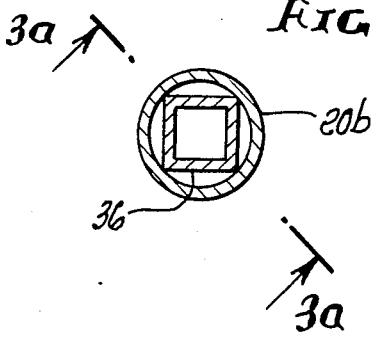
Figure 3A:
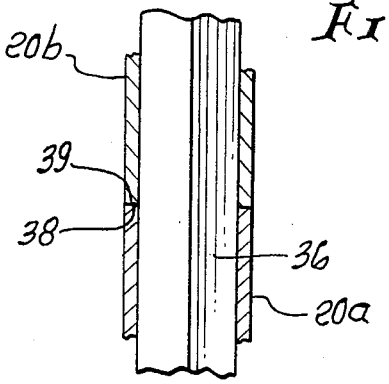
Figure 4:
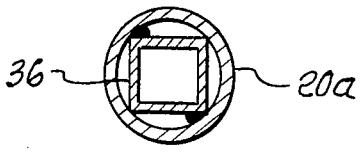
Figure 5:
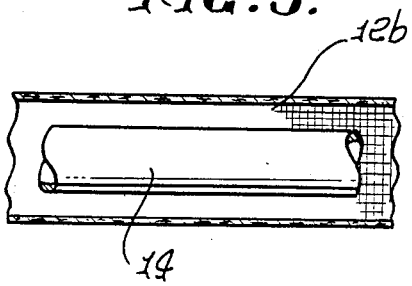
Figure 6:
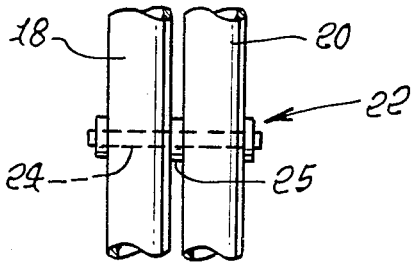
Figure 7:
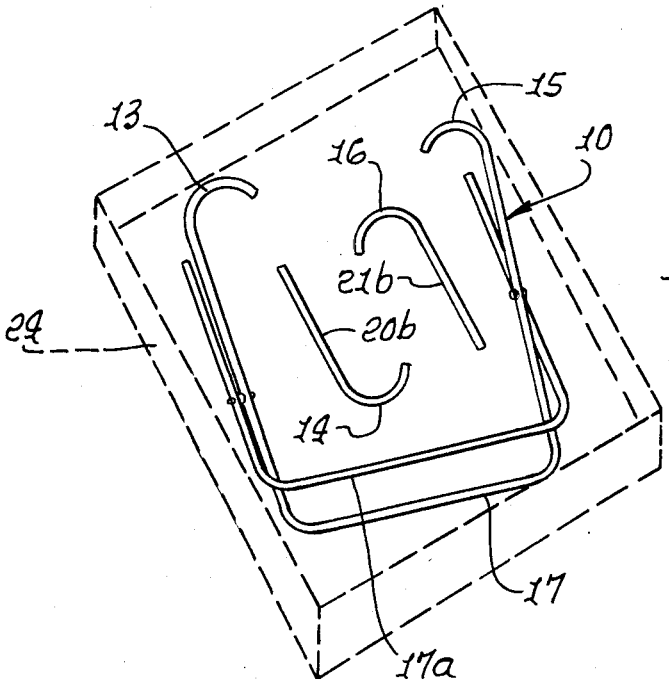

FIGS. 3 and 4 are sections taken on lines 3—3 and 4—4 of FIG. 2;

FIG. 3*a* is a section on lines 3*a*—3*a* of FIG. 3;

FIG. 5 is a fragmentary view on lines 5—5 of FIG. 2;

FIG. 6 is an enlarged fragmentary view showing pivoted interconnection of two adjacent legs; and FIG. 7 is a perspective view showing the chair frame disassembled, collapsed, and packaged.

DETAILED DESCRIPTION

Figure 1:
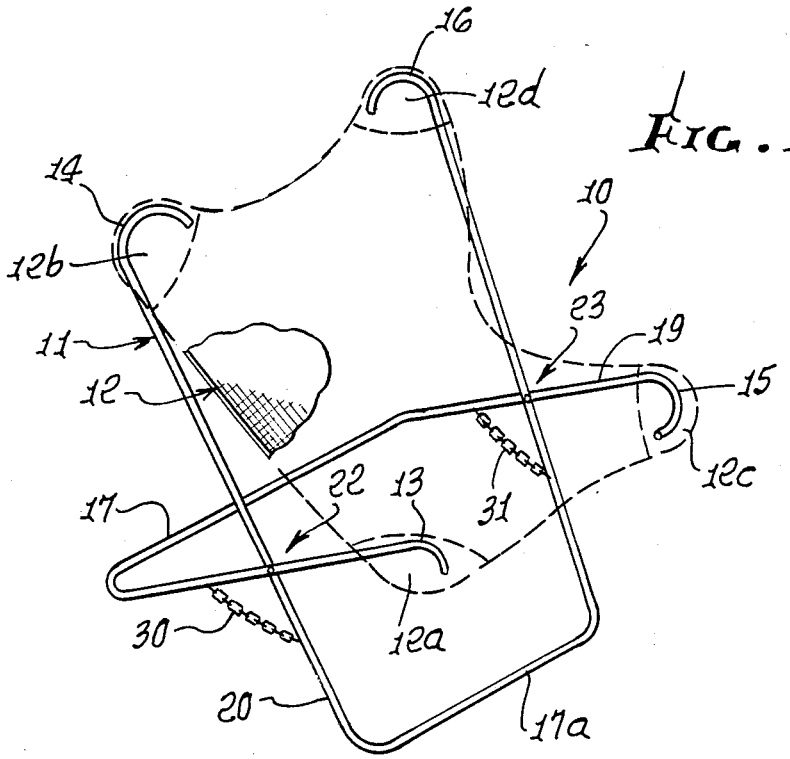
FIG. 1 is a perspective view of an assembled butterfly chair.

The chair 10 in FIG. 1 includes a metallic framework 11 supporting a sheet and backrest 12 made of flexible material, as for example canvas. The sheet 12 includes corner pockets 12*a*–12*d* slung over hook shaped or rounded terminals 13–16 of leg members, to fully support the seat and backrest, despite the fact that the terminals 13–16 terminate, as shown.

More specifically, the framework 11 includes U-shaped tubular members, the first having a lower, floor engaging cross-piece 17, and two first legs 18 and 19 that project upwardly and forwardly; and the second having a lower 17*a* cross-piece and two second legs 20 and 21 that project upwardly and rearwardly. Pivots interconnect the first and second legs at each of two locations 22 and 23, so that the U-shaped members may swivel between raised (FIG. 1) and collapsed (FIG. 7) positions, whereby the chair may be easily shipped in a carton 24 (see FIG. 7) and may be easily raised to FIG. 1 position. See for example pivot pins 24 in FIG. 6 extending through adjacent legs 18 and 20, with a heavy duty annular spacer 25 between the legs as shown. Means to restrain collapse of the legs, in raised position of the frame, comprise lines such as chains 30 and 31, chain 30 connected to legs 18 and 20 and tensioned in FIG. 1; and chain 31 connected to legs 19 and 21, and tensioned in FIG. 1.

In accordance with an important aspect of the invention, the hook-shaped upper terminals 13–16 in pockets 12*a*–12*d* conform to the latter when weight is imposed on the seat and backrest, for stability of the chair. To this end, the hook shaped terminals 14 and 16 are mounted to rotate about axes respectively defined by the second legs 20 and 21. As shown in FIG. 2, leg 20, for example, has lower and upper tubular metallic sections 20*a* and 20*b*, hook 14 is integral with section 20*b*, and it rotates about axis 35. A metallic (or other material) insert 36 typically projects into both sections, and may be typically attached, to lower section 20*a*. Alternatively the insert may be attached to the upper section, or to neither section. The lower end of the insert may seat on the pin 24.

The insert may be polygonal in cross section, for maximum bending strength, and its corners 36*a* than provide bearing supports to engage the bore 37 of upper section 20*b*, enabling it to rotate while still being supported in alignment with section 20*a*. Alternatively, the insert may have other shaped cross section. The ends of the sections 20*a* and 20*b* provide stop shoulders at 38 and 39 which interengage as during such pivoting, and the hooks 14 and 16 and associated pockets then adjust to best support of the sitter, conforming the backrest to his back configuration, for maximum comfort. Either of the tubing sections can be swaged, to closely fit the insert.

Figure 1A:
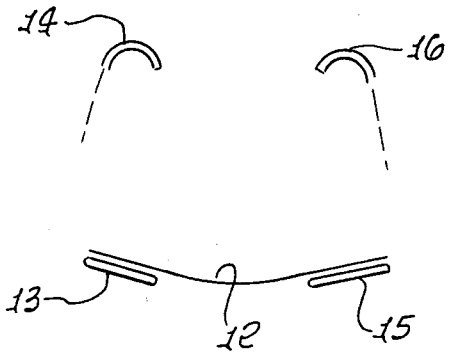
FIG. 1*a* is a schematic front view.

The hook shaped terminals 13 and 15 are integral with legs 18 and 19, and their planes are inclined downwardly and inwardly, as shown, (see FIG. 1*a*), allowing the seat to adapt a downward curvature.

Note also that the legs 18–21 are cantilevered above their pivots at locations 22 and 23, so that they can bend slightly inwardly under weight imposed on the seat, to provide a slight springiness to the chair, aiding conforming of the seat to the sitter.

As is clear, the chair may be very easily lifted out of carton 24, swung to FIG. 1 condition, members 14 and 16 attached, and the flexible seat and backrest 12 slung on hooks 13–16.

I claim:

1. In a folding knock-down chair construction adapting the chair to rapid assembly, the combination comprising:

(a) a framework that includes two U-shaped members, the first having a lower cross piece and two first legs that project upwardly and forwardly, and the second having a lower cross piece and two second legs that project upwardly and rearwardly, (b) pivots interconnecting the first and second legs at two locations, so that said members may swivel between collapsed and extended positions, (c) means restraining collapse of the legs in said extended position, and (d) the upper terminals of said legs being hook shaped and loosely and conformingly received in corner pockets of a flexible sheet providing a seat and backrest, and (e) the upper hook shaped terminals of the second legs extending in offset relation to, and mounted to rotate freely about, longitudinal axes that are defined by said second legs, so as to rotate and thereby conform the backrest to the configuration of the sitter.

2. The combination of claim 1 wherein the hook shaped terminals engage the pockets along curved terminal lengths that are offset from said axes.

3. The combination of claim 1 wherein said second legs have lower and upper sections, the hook shaped terminals integral with said upper sections, there being inserts projecting between the upper and lower sections of each second leg, one section receiving the insert and the other section free to swivel on and relative to the insert.

4. The combination of claim 3 wherein the insert is attached to the lower section and projects upwardly and rearwardly therefrom, and the upper section fits downwardly and forwardly on the projecting insert to pivot relative thereto, and stop shoulders on the sections to seat the lower end of the upper section on the upper end of the lower section.

5. The combination of claim 1 wherein the upper hook shaped terminals of the first legs are fixed and nonrotatable relative to the first legs.

6. The combination of claim 5 wherein said upper hook shaped terminals of the first legs extend inwardly and are inclined downwardly, relative to horizontal.

7. The combination of claim 1 including said flexible sheet which forms said pockets respectively receiving said hook shaped terminals.

8. The combination of claim 3 wherein the lower end of the insert seats on a pivot pin interconnecting the first and second legs.

* * * * *